US007000571B2

(12) United States Patent
Doule et al.

(10) Patent No.: US 7,000,571 B2
(45) Date of Patent: Feb. 21, 2006

(54) HEAT EXCHANGER, AND IN PARTICULAR A STEAM GENERATOR HAVING A CONVEX BOTTOM

(75) Inventors: Alain Doule, Saint Germain du Plain (FR); Gérard Morin, Chalon sur Saone (FR)

(73) Assignee: Framatome ANP, Courbevoie (FR)

( * ) Notice: Subject to any disclaimer, the term of this patent is extended or adjusted under 35 U.S.C. 154(b) by 105 days.

(21) Appl. No.: 10/911,561

(22) Filed: Aug. 5, 2004

(65) Prior Publication Data

US 2005/0092264 A1 May 5, 2005

(30) Foreign Application Priority Data

Aug. 7, 2003 (FR) ..... 03 09742

(51) Int. Cl.
*F22B 37/48* (2006.01)

(52) U.S. Cl. ..... 122/32; 122/382

(58) Field of Classification Search ..... 122/32, 122/486, 491, 492, 508, 382, 405, 460, 467; 165/69, 157, 162
See application file for complete search history.

(56) References Cited

U.S. PATENT DOCUMENTS 3,503,373 A * 3/1970 Sokolowski ..... 122/32
3,854,453 A * 12/1974 Mayer et al. ..... 122/32
4,422,499 A 12/1983 Batistoni
4,653,435 A * 3/1987 Lebouc ..... 122/382
4,883,036 A * 11/1989 Sterk ..... 122/383

FOREIGN PATENT DOCUMENTS

FR 2 271 504 A 12/1975

OTHER PUBLICATIONS

International Search Report, FA 0309742, dated Apr. 22, 2004.

* cited by examiner

*Primary Examiner*—Gregory Wilson
(74) *Attorney, Agent, or Firm*—Connolly Bove Lodge & Hutz LLP

(57) ABSTRACT

The steam generator (1) comprises an outer casing (2) with an axis (8) that is in a vertical disposition when the heat exchanger is in service, a bundle of tubes having straight portions that are parallel to one another and to the axis (8) of the heat exchanger (1) inside the outer casing (2), at least one tube plate (4) having through holes, each receiving the end of a tube of the bundle, and at least one water chamber having a wall (6) that is circularly symmetrical about the axis (8) of the heat exchanger (1), the water chamber being fixed to the tube plate (4) at the bottom of the heat exchanger. The surface (14*a*) of the solid bottom (14) of the heat exchanger includes at least one central point disposed substantially on the axis of the heat exchanger (1) at a highest level relative to the set of points constituting the inside surface (14*a*) of the bottom (14) of the heat exchanger. The set of points constituting the inside surface (14*a*) of the bottom (14) is situated above a conical surface (23) having an apex point at the highest level central point of the inside surface (14*a*) of the bottom (14), an axis parallel to the axis (8) of the heat exchanger, and a half-angle at the apex of about 80°.

8 Claims, 4 Drawing Sheets

HEAT EXCHANGER, AND IN PARTICULAR A STEAM GENERATOR HAVING A CONVEX BOTTOM

The invention relates to a heat exchanger, and in particular a steam generator for a pressurized water nuclear reactor having a water chamber with a bottom that is flat or convex.

BACKGROUND OF THE INVENTION

Nuclear reactors cooled by pressurized water include steam generators that heat and vaporize feed water by heat exchange with the pressurized cooling water of the nuclear reactor. The cooling water circulates through a primary portion of the steam generator comprising the inside volume of heat-exchange tubes in a bundle of tubes and one or more water chambers serving to distribute the primary cooling water amongst the tubes in the bundle and to recover the primary cooling water that has flowed along the tubes. The steam generator also comprises an outer casing surrounding the bundle and defining a secondary portion of the steam generator into which feed water is introduced and caused to flow in contact with the outside surfaces of the tubes in the bundle in order to be heated and vaporized, the resulting steam being recovered in the secondary portion of the steam generator for delivery to the power station turbine, after separating out residual water and drying.

Steam generators of pressurized water nuclear reactors may have a bundle of U-shaped tubes whose ends are fixed in holes passing through a tube plate so that each tube has a first end opening out into a first compartment of the water chamber fixed beneath the tube plate, and a second end opening out into a second compartment of the water chamber. The two compartments of the water chamber are separated from each other by a partition plate. Under such circumstances, the water chamber constitutes the bottom portion of the steam generator when it is in its in-service position, with the axis of the steam generator being vertical, which axis is common to the outer casing of generally cylindrical shape, to the bundle of tubes, and to the tube plates.

The steam generators of pressurized water nuclear reactors may also be generators having straight tubes, with the ends of each tube in the bundle of parallel tubes being fixed in respective holes passing through first and second tube plates, with first and second water chambers being fixed respectively to the first and second tube plates. The steam generator further comprises an outer casing surrounding the bundle and defining the secondary portion of the steam generator between the first and second tube plates.

In its in-service position, the axis of the steam generator is vertical. One of the water chambers is disposed at the bottom end of the steam generator, beneath the first tube plate, and the second water chamber is placed above the second tube plate, at the top end of the steam generator. The first water chamber shares the primary cooling water of the nuclear reactor amongst the tubes of the steam generator bundle, and the second water chamber fixed to the second tube plate at the top end of the steam generator recovers the cooling water that has flowed along the tubes in the bundle.

The water chambers of steam generators in pressurized water nuclear reactors have a circularly symmetrical wall that is generally hemispherical or cylindrical-and-hemispherical, which wall is assembled to the corresponding tube plate in a coaxial disposition.

The circularly symmetrical wall of each water chamber is pierced by an opening to allow primary cooling water to enter into the water chamber or to allow cooling water to be evacuated out from the water chamber, and also by openings constituting inspection holes or manholes in the water chambers.

The water chambers of steam generators located at the bottom ends of the generators, i.e. the single two-compartment water chamber for a steam generator having U-shaped tubes, or the water chamber in a generator having straight tubes that serves to distribute the primary cooling water amongst the tubes of the bundle, have walls in which the through openings are offset laterally away from the axis of the steam generator, with the axes of these openings being inclined relative to the axis of the steam generator.

For a steam generator having U-shaped tubes, each of the compartments of the water chamber has one opening therein receiving a coupling tube for coupling to the primary circuit of the nuclear reactor, and another opening constituting a manhole.

For steam generators having straight tubes, the water chamber situated at the bottom end of the steam generator has one or two openings therein receiving one or two tubes for coupling to the primary circuit, and at least one inspection opening.

The wall of a water chamber disposed at the bottom end of a steam generator has a central portion around the axis of the steam generator between the inside edges of the through openings situated beside the axis of the steam generator, which central portion is entirely solid and is referred to below as the "bottom" of the steam generator. The inside surface of the bottom of the steam generator is concave and can be defined by a linear outline that is tangential to the insides of the through openings in the wall of the water chamber. For a steam generator having U-shaped tubes and a hemispherical water chamber, the partition plate is substantially semicircular in shape, lying on a plane containing the axis of the steam generator and resting on the bottom of the steam generator on a diametral zone of the inside surface of the bottom.

When a maintenance or repair operation is performed on a steam generator after the nuclear reactor has been stopped, it is necessary to empty the steam generator completely, after cooling down and depressurizing the cooling water contained in the primary circuit.

Because of the presence of the concave inside surface of the bottom of the lowest portion of the steam generator, some primary cooling water of the nuclear reactor remains in this bottom portion of the steam generator and cannot be removed via the connection tubes or the manholes. As a general rule, channels referred to as "drains", are provided which pass through the wall of the water chamber between the inside portions of the connection tubes or of the manholes and the concave inside surface of the bottom of the steam generator. However, it is not possible to machine drains in the wall of the water chamber or in portions fitted to the wall in such a manner as to be able to suck out all of the primary cooling water contained in the bottom of the steam generator. The residual cooling water contains activated particles, such that the operations of maintaining and repairing a steam generator are made more complex and the dosage rate to which the operators performing maintenance or repair are subjected can be quite high.

It is therefore desirable to avoid having any residual cooling water present after emptying out steam generators, or more generally heat exchangers likely to contain substances that emit radiation or substances that are toxic.

OBJECTS AND SUMMARY OF THE INVENTION

The object of the invention is thus to provide a heat exchanger, in particular a steam generator comprising a generally cylindrical outer casing having an axis constituting the axis of the heat exchanger that is in a vertical disposition when the heat exchanger is in service, a bundle of tubes having straight portions that are parallel to one another and to the axis of the heat exchanger inside the outer casing, at least one tube plate having through holes, each having secured therein one end of a tube of the bundle, the tube plate being assembled to one end of the outer casing, at least one water chamber having a wall that is circularly symmetrical about the axis of the heat exchanger fixed to the tube plate at the bottom portion of the heat exchanger, at least one opening passing through the wall of the water chamber in a position that is laterally offset from the axis of the heat exchanger, the wall of the water chamber having an inside surface with a central portion situated around the axis of the heat exchanger constituting the inside surface of a solid bottom of the heat exchanger, said heat exchanger enabling a heat-exchange fluid contained in a primary portion of the steam generator constituted by the bundle of tubes and the water chamber to be emptied completely.

For this purpose, in the in-service position of the heat exchanger with its axis vertical, at least one central point of the solid bottom surface of the heat exchanger and disposed substantially on the axis of the heat exchanger constitutes the highest level relative to the set of points constituting the inside surface of the bottom of the heat exchanger, and the set of points constituting the inside surface of the bottom is situated above a conical surface having an apex point at the highest level of the inside surface of the bottom, an axis that is parallel to the axis of the heat exchanger, and a half-angle at the apex of about 80°.

The heat exchanger of the invention may present the following characteristics in isolation or in combination:

- the inside surface of the bottom of the steam generator is made as a roof shape having a horizontal ridge containing the central point and two downwardly-sloping plane portions sloping at an angle lying in the range 0.5° to 10° relative to a horizontal plane, away from the horizontal ridge and towards the peripheral portion of the surface of the bottom having at least one opening out therein;
- the inside surface of the bottom of the heat exchanger is a cone having the central point as its apex, the axis of the steam generator as its axis, and a half-angle at the apex greater than 80°;
- the inside surface of the bottom of the heat exchanger is a substantially horizontal plane surface containing the central point;
- the inside surface of the bottom of the steam generator is a cylindrical surface having a horizontal axis intersecting the axis of the steam generator and having a generator line passing through the central point; and
- the inside surface of the bottom of the heat exchanger is a spherical cap having its top at the central point and an outline that is tangential to the inside edges of openings passing through the wall of the water chamber.

In particular, the invention provides:

- a heat exchanger constituting a steam generator having a bundle of U-shaped tubes, a single water chamber subdivided in two compartments by a partition plate disposed on a plane containing the axis of the heat exchanger and resting on the inside surface of the solid bottom of the water chamber, each of the tubes of the bundle having a first end passing through the tube plate so as to open out into a first compartment of the water chamber, and a second end engaged in an opening through the tube plate so as to open out in a second compartment of the water chamber, wherein the horizontal ridge of a roof shape containing the central point lies in the axial plane in which the partition plate is disposed, each of the sloping plane portions of the roof shape being disposed in a respective one of the compartments of the water chamber and constituting a compartment bottom sloping downwards from the horizontal ridge to the periphery of the bottom of the compartment where there is placed the inside edge of at least one opening passing through the wall of the water chamber; and
- a heat exchanger in the form of a straight tube steam generator comprising first and second water chambers, the first water chamber being disposed at the end of the straight tube heat exchanger which is at the bottom when the heat exchanger is in its in-service position, wherein the inside surface of the first water chamber situated at the bottom end of the heat exchanger is flat or convex.

BRIEF DESCRIPTION OF THE DRAWINGS

In order to make the invention well understood, there follows a description, given by way of example made with reference to the accompanying figures, of steam generators for nuclear reactors cooled by pressurized water, both as made in accordance with the prior art, and as made in accordance with the invention.

MORE DETAILED DESCRIPTION

Figure 1:
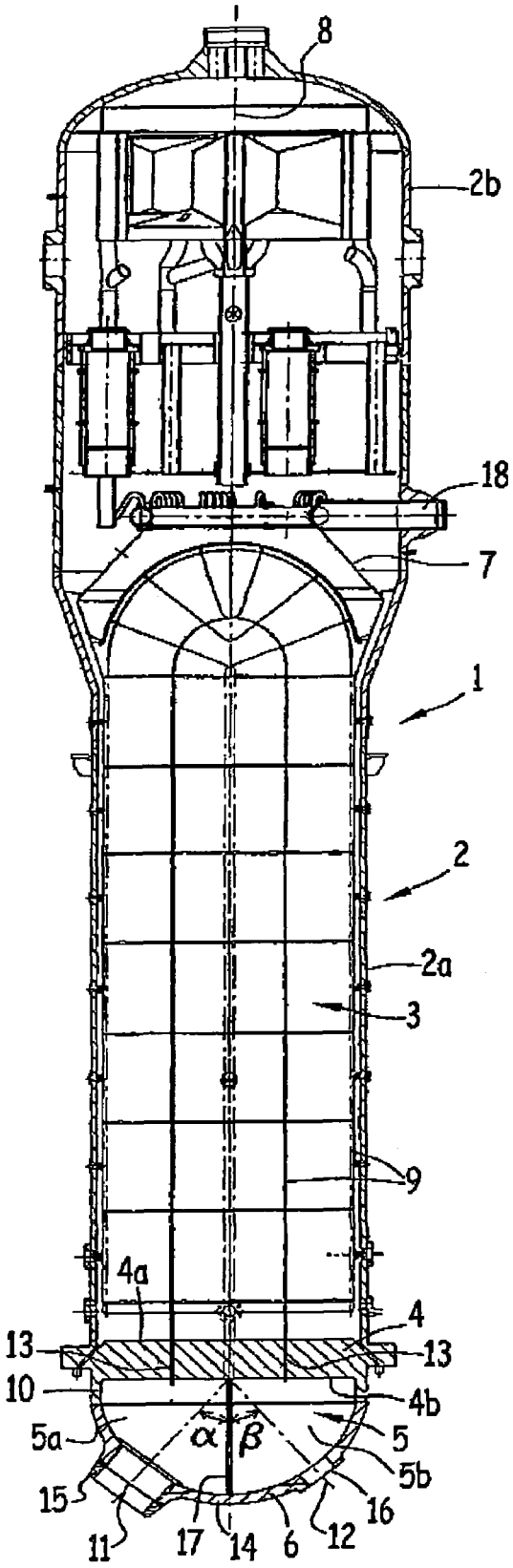
PRIOR ART FIG.1
FIG. 1 is an axial section view of a steam generator having U-shaped tubes for a pressurized water nuclear reactor and in accordance with the prior art.

FIG. 1 shows a steam generator given overall reference 1, comprising an outer casing 2 with a bottom portion 2*a* containing the bundle of tubes 3 of the steam generator, and a top portion 2*b* of diameter greater than that of the portion 2*a* and containing moisture separators and steam dryers.

The tubes 9 of the bundle 3 of the steam generator have their ends fixed in a thick tube plate 4 of circular shape having fitted and secured thereto by welding the hemispherical wall 6 of a water chamber 5 constituting the bottom portion of the steam generator when it is in its in-service position with the axis 8 of the steam generator vertical, as shown in FIG. 1.

The water chamber 5 of the steam generator is subdivided into a first compartment 5*a* and a second compartment 5*b* by a partition 17 disposed in a plane containing the axis 18 of the steam generator and secured on the inside surface of the wall 6 of the water chamber.

The wall 6 of the water chamber 5 is pierced by openings such as 15 that receive tubes for connecting the water chamber to the primary circuit of the nuclear reactor in which cooling water flows under pressure. The wall of the water chamber is also pierced by inspection openings 16 or manholes.

In each of the compartments 5*a* and 5*b* of the water chamber, there is one opening 15 for connecting the water chamber to the primary circuit and another opening constituting an inspection hole or manhole 16.

The openings 15 for connecting the water chamber to the primary circuit via connection tubes, and the inspection openings 16 have respective axes 11 and 12 in axial section planes of the steam generator, as shown in FIG. 1, that are inclined to make an acute angle with the axis 8 of the steam generator, the openings 15 and 16 being offset laterally from the axis 8 of the steam generator.

The axes 11 and 12 of the openings 15 having the connection tubes and of the inspection openings 16 make respective angles of inclination $\alpha$ and $\beta$ relative to the axis 8 of the steam generator that are generally different, and the diameters of the openings 15 are greater than the diameters of the inspection openings 16.

Around the axis 8, the wall 6 of the water chamber 5 presents a solid portion 14 extending to the inside edges of the openings 15 and 16 that are beside the axis 8. The solid wall 14 constitutes the lowest portion or bottom of the steam generator.

The tube plate 4 has a very large number of through holes 13 (about 5000) each serving to receive an end portion of one of the tubes 9 in the bundle. The bundle 3 of tubes 9 is disposed inside the outer casing 2 that is welded at its bottom end to the tube plate 4, generally inside a bundle casing 7. The feed water for the steam generator is introduced into the secondary portion of the steam generator, at the top end of the bundle casing 7, via a feed torus 18.

Figure 2:
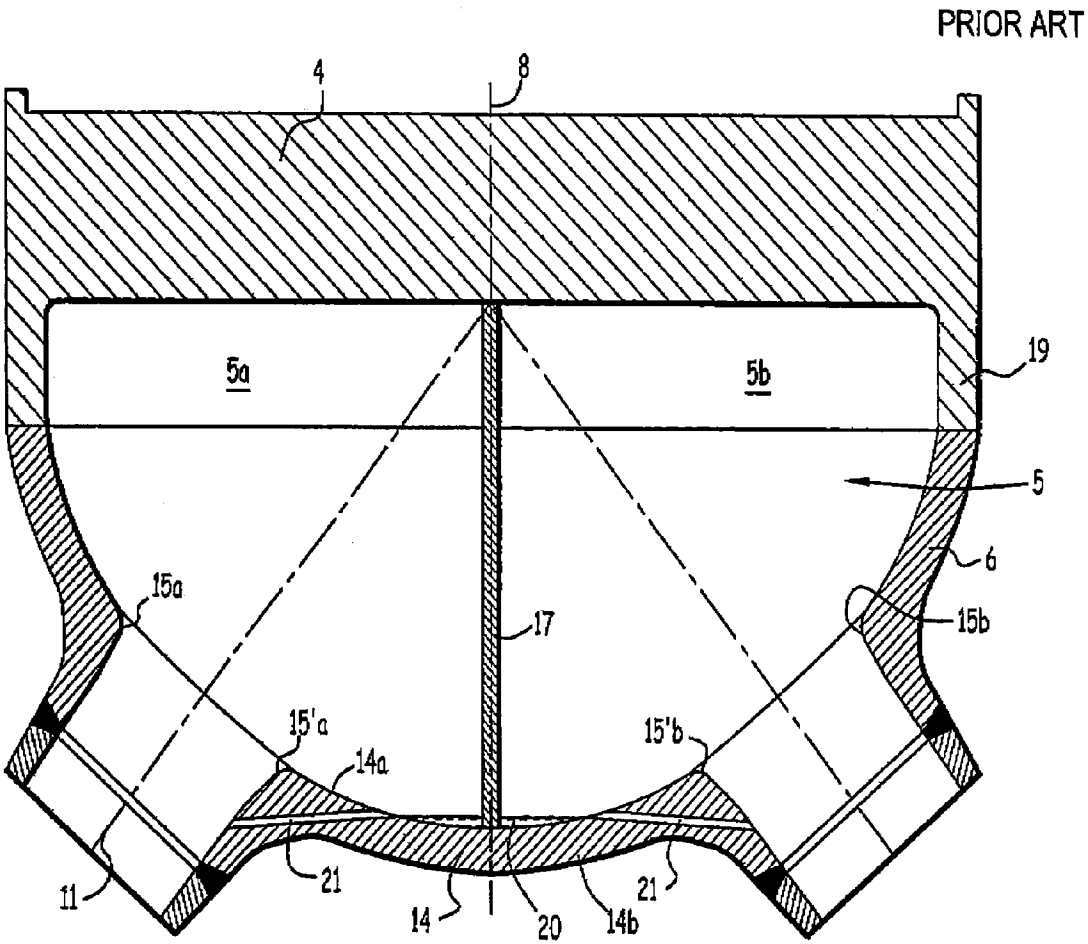
FIG. 2 is a section view on a larger scale of the water chamber of the prior art steam generator as shown in FIG. 1.

FIG. 2 is on a larger scale than FIG. 1 and shows the bottom portion of the steam generator including the tube plate 4 and the water chamber 5 whose hemispherical wall 6 is welded to a connection ring 19 integral with the tube plate 4. The water chamber 5 is cylindrical-and-hemispherical in shape and is subdivided into two compartments 5*a* and 5*b* by a partition 17 whose circular peripheral edge terminated by two straight portions is fitted to and secured against the inside surface of the wall 6 of the water chamber 5. The circular junction zone of the partition plate bears against the lowest central portion of the solid bottom 14 of the steam generator.

FIG. 2 shows two openings 15*a* and 15*b* for connecting the water chamber to the primary circuit via tubes which can be fitted to or integral with the wall 6 of the water chamber 5.

The concave inside surface 14*a* of the solid bottom 14 of the steam generator is in the form of a spherical cap and, after the steam generator has been completely emptied, this cap constitutes, on either side of the partition 17, two dishes that retain primary cooling water and activated debris 20 in the bottom of the steam generator. Drains 21 are machined inside the connection tubes in the openings 15*a* and 15*b* of the water chamber between the inner bores of said tubes 15*a* and 15*b* and a zone that is as close as possible to the central zone of the bottom 14 of the steam generator in order to enable suction to be used to minimize the quantity of residual water 20 and debris that remains in the bottom of the steam generator. Nevertheless, as can be seen in FIG. 2, it is not possible to provide drains 21 capable of sucking out all of the residual water and debris that is contained in the bottom of the water chamber.

Figure 3:
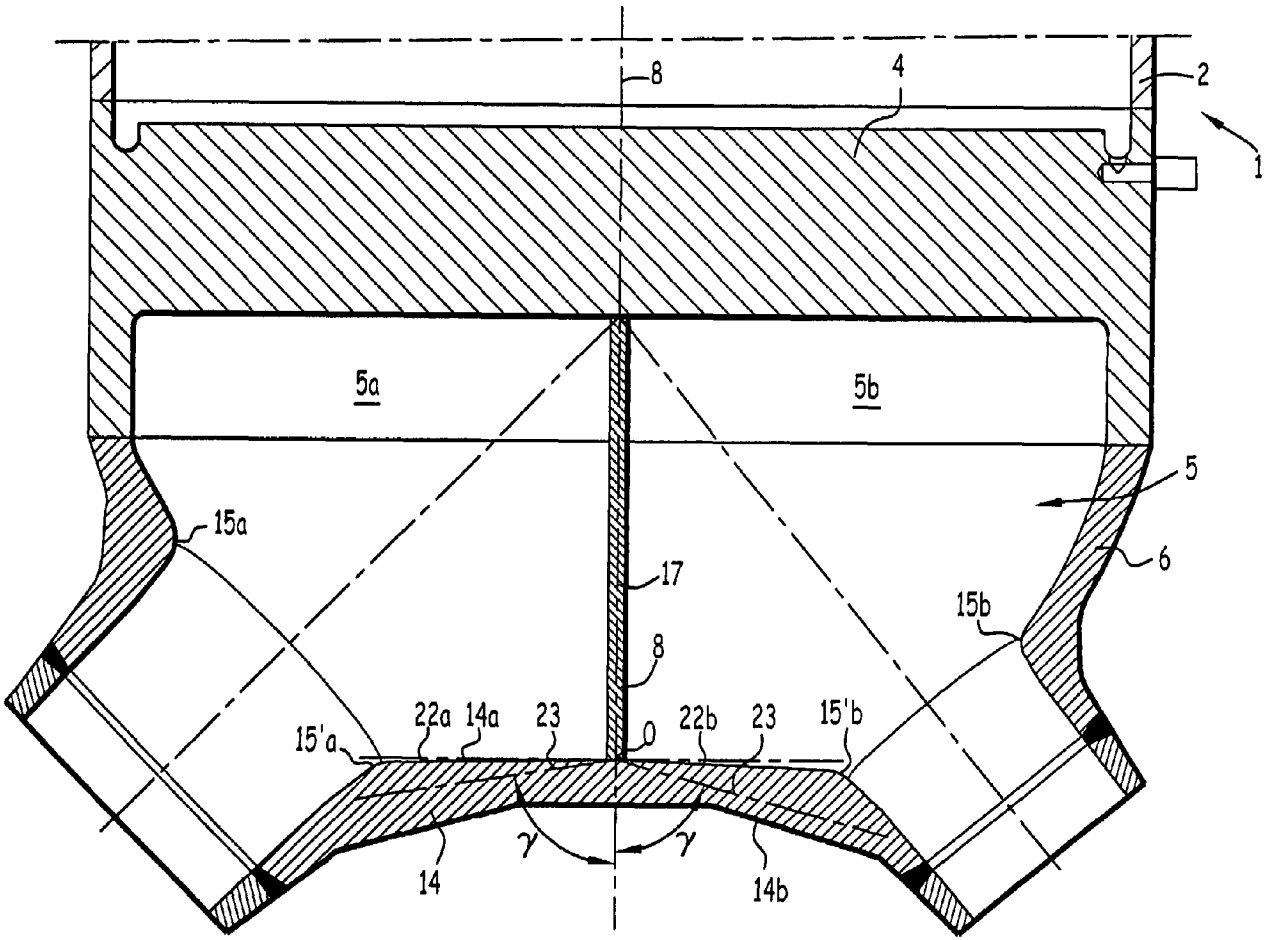
FIG. 3 is an axial section view analogous to the view of FIG. 2 showing a water chamber of a steam generator in accordance with the invention.

FIG. 3 shows the bottom portion of a steam generator of the invention comprising a bottom 14 whose inside surface 14*a* is convex, so as to avoid any residual water being present in the steam generator after the primary portion of the steam generator has been completely emptied.

Corresponding elements in FIGS. 2 and 3 are given the same references.

The inside surface 14*a* of the bottom 14 is situated between the inside edges 15'*a* and 15'*b* of the openings 15*a* and 15*b* and between the inside edges (not visible in FIG. 3) of the inspection openings 16 in each of the compartments 5*a* and 5*b* of the water chamber, the inside edges being the portions of the openings that are closest to the axis 8 of the steam generator.

The outline of the inside surface 14*a* of the bottom 14 may be defined by a closed curved line that is tangential to the inside edges of the through openings in the wall 6 of the water chamber.

In the particular embodiment shown in FIG. 3, the inside surface 14*a* of the bottom 14 of the steam generator comprises two plane surfaces 22*a* and 22*b* sloping in opposite directions from each other relative to a horizontal plane and extending away from a horizontal ridge perpendicular to the plane of FIG. 3 and intersecting the plane of FIG. 3 at a point O, to the peripheral edge of the surface 14*a* that is tangential to the inside edges of the openings through the wall 6 of the water chamber 5. The two plane surface portions 22*a* and 22*b* of the inside surface 14*a*, of the bottom 14 have their highest level along the horizontal ridge represented by point O, with their lowest levels following the outline of the inside surface 14*a* and they slope at a shallow angle relative to the horizontal, e.g. at an angle of about 0.5° to 10°. The inside surface 14*a* of the bottom 14 is thus generally in the form of a roof with two slopes at a very small angle.

The bottom portion of the partition plate 17 is machined so as to be pressed accurately against the adjacent portion of the horizontal ridge of the roof formed by the surfaces 22*a* and 22*b*. The vertical diametral plane occupied by the partition plate 17 intersects the ridge of the roof identified by point O.

The inside surface 14*a* of the bottom 14 having two slopes can be obtained by internally forging the wall 6 of the water chamber and/or by machining so as to make the two sloping plane surfaces 22*a* and 22*b* with very great precision. In contrast, the outside surface of the bottom 14 may be of any shape, e.g. in the form of a convex spherical cap, as with prior art steam generators, or in the form of an upside-down dish having a partially frustoconical surface 14*b*, as shown in FIG. 3, in order to reduce the thickness of the bottom 14.

The above-described roof shape with two slopes for the inside surface 14*a* of the bottom 14 is merely one example of how the bottom of a steam generator in accordance with the invention can be provided.

More generally, the inside surface 14*a* of the bottom of a steam generator in accordance with the invention may be defined as described below.

The inside surface 14*a* of the bottom 14 includes at least one point situated in its central portion in the vicinity of the axis 8 of the steam generator which is at the highest level in the vertical direction of the set of the points constituting the inside surface 14*a* of the bottom 14.

When shaped like a roof having two slopes as described above, the surface 14*a* comprises a set of points situated on the diametral direction represented by point O in FIG. 3 that constitutes the highest level of the surface 14*a*.

The point O situated substantially on the axis 8 of the steam generator constitutes a reference point suitable for defining all inside surfaces 14*a* for generator bottoms in accordance with the invention.

Starting from the central point O, a conical surface 23 is defined having its apex at point O, an axis parallel to the axis 8 of the steam generator, and a half-angle at the apex γ that is substantially equal to 80° (in FIG. 3, the angle γ is significantly smaller than 80° in order to make the cone 23 more visible). The set of points constituting the inside surface 14*a* of the bottom 14 of a steam generator in accordance with the invention must lie above the conical surface 23 obtained in the manner defined above.

A first particular case for the inside surface 14*a* of the bottom of the steam generator is a horizontal plane passing through the point O and thus through the horizontal diametral line represented by the point O and passing through the inside edges of openings such as 15 and 16, or in the immediate vicinity thereof.

A second example is a surface in the form of a roof having two slopes presenting a horizontal ridge line represented by the point O with an angle of inclination lying in the range 0.5° to 10°.

For a steam generator having U-shaped tubes with a water chamber that is subdivided into two compartments by a partition plate, the plate occupies a plane containing the axis and the ridge of the roof, and the two plane portions slope downwards from their intersections with respective faces of the partition plate to the peripheral portion of the bottom of the corresponding compartment into which openings such as 15 and 16 open out via their inside edges.

A third example of a surface 14*a* is a conical surface having as its apex a central point O situated at the highest level of the surface 14*a*, an axis parallel to the axis of the steam generator, and a half-angle at the apex greater than 80°.

A fourth example of an inside surface 14*a* for the bottom 14 is a portion of a cylinder having a horizontal axis approximately intersecting the axis of the steam generator and a very large radius of curvature, with one of its generator lines passing through the point O.

A fifth example of an inside surface 14*a* for the bottom 14 of a steam generator in accordance with the invention is a spherical cap whose top is located at the point O, with the remainder of the cap being situated entirely above the conical surface 23 and with the cap having an edge that follows the periphery of the inside surface 14*a* of the bottom 14.

In all cases, the bottom edge of the partition plate 17 must be of a shape that matches the section of the inside surface 14*a* of the bottom 14 on the axial plane occupied by the partition plate 17.

When emptying the primary portion of the steam generator, no traces of cooling water or debris can remain since they are entrained towards the connection tubes or the inspection holes by the sloping surface(s) of the inside surface 14*a* of the bottom 14.

For a surface 14*a* that is practically plane, using a surface that is entirely smooth and made by machining makes it possible to have practically no traces of cooling water in the bottom of the steam generator, even though there is no slope.

These results are obtained without using drains opening out at one end into the bore of an opening passing through the wall 6 of the water chamber and an opposite end opening out into the inside surface 14*a* of the bottom 14. Nevertheless, such drains could still be of use in order to further improve elimination of cooling water by suction or by blowing.

Figure 4:
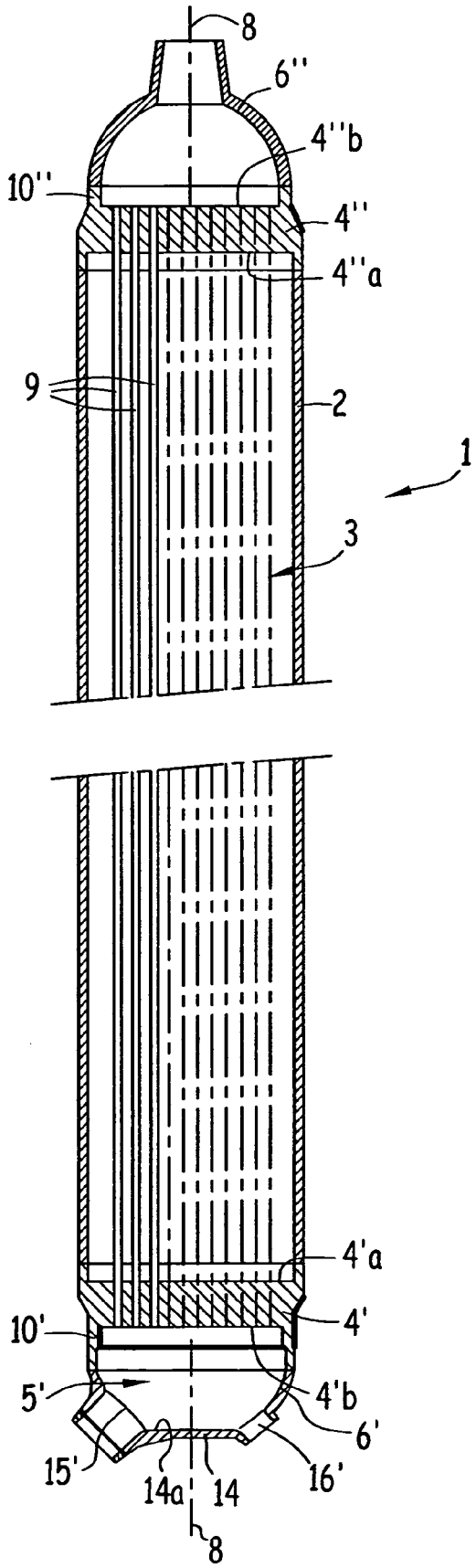
FIG. 4 is an axial section view of a steam generator in accordance with the invention and having tubes that are straight.

FIG. 4 shows a steam generator having straight tubes for a pressurized water nuclear reactor, with elements that correspond between the straight-tube steam generator shown in FIG. 4 and the U-tube steam generator shown in FIG. 1 being identified by the same references. In particular, the steam generator as a whole, the outer casing, the bundle, and the tubes in the bundle are designated by references 1, 2, 3, and 9 respectively. The straight-tube steam generator 1 has a first tube plate 4' and a second tube plate 4" with openings passing therethrough, each opening receiving and being secured to the end of a tube 9 in the bundle 3.

The bundle 3 of the steam generator is disposed inside the outer casing 2 which is connected at its ends to the first and second tube plates 4' and 4", respectively.

A first water chamber 5' comprises a hemispherical or a cylindrical-and-hemispherical wall secured by welding to the first tube plate 4'.

A second water chamber comprises a hemispherical or a cylindrical-and-hemispherical wall secured to the second tube plate 4".

In FIG. 4, the steam generator 1 is shown in its in-service position, the first water chamber 5', constituting the bottom portion of the steam generator, is for causing cooling water from the reactor to flow in the tubes of the bundle 3 of the steam generator. The wall 6' of the first water chamber 5' is pierced by one or two openings 15' depending on whether the wall 6' has one or two connection tubes to the primary circuit of the nuclear reactor, and by an opening 16' constituting an inspection opening or manhole. The central portion of the wall 6' of the water chamber 5' around the axis 8, as defined by the inside edges of the openings 15' and 16', constitutes the solid bottom of the steam generator disposed at the lowest portion thereof.

The straight-tube steam generator of the invention shown in FIG. 4 wherein an inside surface 14*a* for its solid bottom 14 presents the same characteristics as those described above for a steam generator having U-tubes. The surface 14*a* includes at least one central point O at its highest level, and all of the points of the surface 14*a* are located above a cone whose vertex is the point O, whose axis is parallel to the axis 8 of the steam generator, and having a half-angle at the apex that is substantially equal to 80°.

The inside surface 14*a* of the bottom 14 of the straight tube steam generator may be in the form of a roof, it may be flat, it may be conical, spherical, or cylindrical, as described above.

The top water chamber of the steam generator is unchanged, since it does not include any portions likely to retain cooling water when the steam generator is emptied.

The invention is not limited to the embodiments described.

The bottom of the steam generator may present any shape satisfying the general conditions as specified, i.e. shapes other than the geometrical shapes described above. Nevertheless, the inside surface of the bottom must be continuous and preferably sloping, and it should not present any indentations that might retain water or radioactive debris when the steam generator is emptied.

The change to the shape of the inside surface of the bottom of the steam generator tends to reduce the total volume of the water chamber. This reduction in volume can be compensated, for example, by providing a cylindrical portion of greater length in a water chamber that is cylindrical-and-hemispherical.

In general, the invention applies not only to steam generators for pressurized water nuclear reactors having U-tubes or straight-tubes, but it also applies to any heat generator having a water chamber at its end which is at the bottom when in the in-service position, where the water chamber has a solid bottom between connection openings or openings for inspecting the water chamber.

What is claimed is:

1. A heat exchanger, in particular a steam generator comprising a generally cylindrical outer casing having an axis constituting the axis of the heat exchanger that is in a vertical disposition when the heat exchanger is in service, a bundle of tubes having straight portions that are parallel to one another and to the axis of the heat exchanger inside the outer casing, at least one tube plate having through holes, each having secured therein one end of a tube of the bundle, the tube plate being assembled to one end of the outer casing, at least one water chamber having a wall that is circularly symmetrical about the axis of the heat exchanger fixed to the tube plate at a bottom portion of the heat exchanger, at least one opening passing through the wall of the water chamber in a position that is laterally offset from the axis of the heat exchanger, the wall of the water chamber having an inside surface with a central portion situated around the axis of the heat exchanger constituting the inside surface of a solid bottom of the heat exchanger, the heat exchanger being in the in-service position of the heat exchanger with its axis vertical, at least one central point of the solid bottom surface of the heat exchanger disposed substantially on the axis of the heat exchanger and constituting the highest level relative to a set of points constituting the inside surface of the bottom of the heat exchanger, and the set of points constituting the inside surface of the bottom being situated above a conical surface having an apex point at the highest level of the inside surface of the bottom, an axis that is parallel to the axis of the heat exchanger, and a half-angle at the apex of about 80°.

2. A heat exchanger according to claim 1, wherein the inside surface of the bottom of the steam generator is made as a roof shape having a horizontal ridge containing the central point and two downwardly-sloping plane portions sloping at an angle lying in the range 0.5° to 10° relative to a horizontal plane, away from the horizontal ridge and towards the peripheral portion of the surface of the bottom having at least one opening therein.

3. A heat exchanger according to claim 2, constituting a steam generator having a bundle of U-shaped tubes, a single water chamber subdivided in two compartments by a partition plate disposed on a plane containing the axis of the heat exchanger and resting on the inside surface of the solid bottom of the water chamber, each of the tubes of the bundle having a first end passing through the tube plate so as to open out into a first compartment of the water chamber, and a second end engaged in an opening through the tube plate so as to open out in a second compartment of the water chamber, wherein the horizontal ridge of the roof shape containing the central point lies in the axial plane in which the partition plate is disposed, each of the sloping plane portions of the roof shape being disposed in a respective one of the compartments of the water chamber and constituting a compartment bottom sloping downwards from the horizontal ridge to the periphery of the bottom of the compartment where there is placed the inside edge of at least one opening passing through the wall of the water chamber.

4. A heat exchanger according to claim 1, wherein the inside surface of the bottom of the heat exchanger is a cone having the central point as its apex, the axis of the steam generator as its axis, and a half-angle at the apex greater than 80°.

5. A heat exchanger according to claim 1, wherein the inside surface of the bottom of the heat exchanger is a substantially horizontal plane surface containing the central point.

6. A heat exchanger according to claim 1, wherein the inside surface of the bottom of the steam generator is a cylindrical surface having a horizontal axis intersecting the axis of the steam generator and having a generator line passing through the central point.

7. A heat exchanger according to claim 1, wherein the inside surface of the bottom of the heat exchanger is a spherical cap having its top at the central point and an outline that is tangential to the inside edges of openings passing through the wall of the water chamber.

8. A heat exchanger according to claim 1, implemented in the form of a straight tube steam generator comprising first and second water chambers, the first water chamber being disposed at the end of the straight tube heat exchanger which is at the bottom when the heat exchanger is in its in-service position, wherein the inside surface of the first water chamber situated at the bottom end of the heat exchanger is flat or convex.

* * * * *